US005372361A

United States Patent [19]

Isobe et al.

[11] Patent Number: 5,372,361

[45] Date of Patent: Dec. 13, 1994

[54] BILL HANDLING APPARATUS WITH EXCHANGEABLE PUSHER FOR STACKER

[75] Inventors: Atsushi Isobe; Masanobu Fujita, both of Kawasaki; Taichi Sato, Atsugi; Takayuki Takeda, Kanagawa, all of Japan

[73] Assignee: Japan Cash Machine Co. Ltd., Osaka, Japan

[21] Appl. No.: 152,294

[22] Filed: Nov. 15, 1993

[30] Foreign Application Priority Data

Nov. 13, 1992 [JP] Japan ..... 4-078207[U]
Nov. 27, 1992 [JP] Japan ..... 4-081980[U]

[51] Int. Cl.[5] ..... B65H 29/00

[52] U.S. Cl. ..... 271/181; 271/198; 271/213; 194/203

[58] Field of Search ..... 271/3, 177, 180, 181, 271/198, 213, 219; 194/203

[56] References Cited

U.S. PATENT DOCUMENTS 4,809,966 3/1989 Kobayashi et al. ..... 271/181
4,809,967 3/1989 Kondo ..... 271/213
5,103,725 4/1992 Sugimoto et al. ..... 271/213
5,195,739 3/1993 Watabe ..... 271/181
5,209,395 5/1993 Zouzoulas et al. ..... 271/181
5,288,066 2/1994 Hair ..... 271/198

FOREIGN PATENT DOCUMENTS 004123887 6/1992 Germany ..... 194/203

*Primary Examiner*—H. Grant Skaggs
*Attorney, Agent, or Firm*—Bachman & LaPointe

[57] ABSTRACT

A casing of a stacker is provided with an opening and a chamber for disposing a pusher within the casing adjacent to the opening so that the pusher can be removably attached within the stacker. Also provided in the pusher is a slit-shaped inlet connected with an exit of a passageway within a transporter. By removing the pusher from the stacker and attaching same to another stacker having its compartment of different capacity, bill storing capacity may easily be changed. In malfunction of the pusher, it may easily be exchanged with new one for easy maintenance.

9 Claims, 10 Drawing Sheets

BILL HANDLING APPARATUS WITH EXCHANGEABLE PUSHER FOR STACKER

BACKGROUND OF THE INVENTION

1. Field of the Invention

This invention relates to an apparatus for handling paper money, such as a bill exchanger, an automatic bending machine, etc., more particularly, concerns a currency handling apparatus provided with a stacker to store bills fed into the apparatus.

2. Description of the Prior Art

A current bill handling apparatus includes money exchanging or vending machines each provided with a paper money detecting device or a validator for identifying the authenticity or denomination of a bill, bank note or paper currency inserted therein. When inserted into an inlet of the validator, the bill is conveyed along a passageway by a belt-pulley arrangement through sensors which detect optical or magnetic characteristics of the bill. In a typical bill handling apparatus of this kind, the validator discriminates between real money and counterfeit money for a bill fed into the apparatus by a central processing unit (CPU) composed of a microcomputer on the basis of data detected from the bill, and it passes a bill only when judged as valid and real money. After the validator checks the inserted bill and detects same physical properties as those of a genuine bill from outputs of the sensors, the validated bill is transported by the conveying device and stored in a compartment of a storing box called "stacker" wherein bills are accumulated for storage while exchanged bills, coins or goods are put out in a tray of the machine. Adversely, if the validator can not decide the inserted bill as genuine, the belt-pulley arrangement is driven in the reverse direction to return the bill to the inlet. For instance, U.S. Pat. No. 4,629,194 to Bob M. Dobbins, et al. indicates a prior art validator and U.S. Pat. No. 4,722,519 to John Zouzoulas shows a stacker apparatus.

When filled up with bills, the stacker is detached from the apparatus, and the bills are removed from the stacker, and the empty stacker is attached again to the apparatus. A pushing device is rigidly mounted in the stacker to forcibly push a bill supplied from the conveying device into the compartment in the stacker. This pushing device has link members connected into X shape each other with hinges, and each end of link members is attached to a pushing plate. Therefore, when the link members are operated for extension or retraction, the pushing plate is moved forward or backward to forcibly push the bill into the compartment of the stacker. Also, provided in a casing of the stacker is a slit-shaped intake port connected with an exit of a passageway of the conveying device to smoothly convey a bill.

However, as a pushing device of the conventional bill handling apparatus is fixedly incorporated in a stacker as one unit, it needs a new stacker with a pushing device to increase or reduce capacity or volume for storing bills in the stacker. Therefore, a conventional bill handling apparatus has defects in that the pushing device can not be exchanged with another one and in that bill storing capacity can not easily be adjusted. Also, when a pushing device under malfunction or breakdown is required to be replaced with new one, it needs replacement of an incorporated stacker itself, and thereby makes maintenance operation difficult.

SUMMARY OF THE INVENTION

Accordingly, it is an object of this invention to provide a bill handling apparatus with an exchangeable pusher for stacker.

It is another object of the invention to provide a bill handling apparatus with exchangeable pusher for easy maintenance.

It is still another object of the invention to provide a bill handling apparatus with exchangeable pusher being capable of preventing unauthorized withdrawal of a stacked bill.

A bill handling apparatus according to the present invention includes a validator for checking a bill fed into the apparatus whether or not the bill is genuine: a stacker detachably mounted in the apparatus and having a casing for defining a compartment to store the accumulated bills; and a transporter for conveying the bill along a passageway from the validator to the stacker. The stacker further comprises a chamber defined by the casing; a pusher removably located within the chamber of the stacker and drivingly connected with the transporter for pushing the bill into the compartment; an opening formed in the casing in the vicinity of the chamber for passing the pusher; and a slit-shaped inlet formed in a base plate of the pusher for receiving the bill within the pusher. The inlet is connected to an exit of the passageway of the transporter. The transporter comprises a motor for driving an endless belt and an end gear driven by the motor. The pusher comprises a passive gear for operating link members to push the bill from the chamber into the compartment. The passive gear is brought into engagement with the end gear of the transporter for driving connection. The passive gear may be disengaged from the end gear when the stacker is removed from the transporter. The transporter further comprises a gear bracket for hingedly supporting the end gear; and a shock absorbing spring provided between the gear bracket and a frame of the apparatus for absorbing impact force produced between the end and passive gears when the stacker is incorporated with the transporter. The pusher comprises link members and a pusher plate hingedly connected with the link members. The link members travel the pusher plate between the retracted and extended positions by virtue of elastic force of a spring and driving force of a motor provided in the transporter. The pusher comprises a winding gear rotatably mounted on a shaft and being brought into engagement with an end gear of the transporter for disengagement when the stacker is incorporated with the transporter; a winding roller mounted on the shaft via one-way clutch device contained therein; a slider slidably mounted on a base plate of the pusher for hingedly supporting one end of the link members; a slider pulley rotatably mounted on the slider; a slider spring for resiliently urging the slider away from the shaft; and a tensile wire wound around the slider pulley. One end of the tensile wire is connected with the base plate and the other end of the tensile wire is wound around the winding roller. Thereby, the one way clutch device allows to release the tensile wire from the winding roller by resilient force of the slider spring when the motor is driven in the forward direction to convey the bill through the passageway in the transporter so that the slider is moved away from the winding roller, and the link members and pusher plate are carried to the retracted position. The one-way clutch device serves to rotate the winding roller together with the shaft to wind up the tensile wire around the winding roller when the motor is driven in the reverse direction so that the slider is moved toward the winding roller, and the link members and pusher plate are carried to the extended position.

The stacker comprises a pair of guide members each attached on a side wall of the casing; and a back plate movable along a pair of the guide members; The stacker further comprises a spring for resiliently urging the back plate toward the pusher; and a pair of stoppers each provided at both ends of the guide members to prevent the back plate from entering into a front portion of the compartment. The transporter provides at least a bent portion with the passageway and comprises hook means for preventing extraction of the bill within the stacker out of the apparatus. The hook means is mounted between the bent portion and the stacker, and comprises sensing means provided on the passageway within the transporter for detecting passage of the bill supplied from the validator; a lever rotatable between its operative position projecting into the passageway and its inoperative position retracted from the passageway; and drive means for operating the lever of the hook means when the sensing means detects the passage of the bill.

The pusher may be removed from the casing of the stacker and attached to another stacker with a casing of different capacity for storing bills. In order to change capacity or volume for storing bills in the stacker, the pusher may be applied for common use to another stacker with its compartment of different volume, and therefore there is no need to prepare a new pusher of different size or type. In addition, when the pusher is in malfunction, it may easily be removed for exchange with a new pusher and a same pusher is applicable to stackers of various size without change of the pusher in size and without increase of kind or type of the pusher for easy maintenance. The pusher can easily be inserted along the guide members in the chamber within the casing of the stacker.

The lever of the hook means can receive a tool which might be inserted to rotate the lever for the purpose of unauthorized withdrawal of the bill in the stacker to prevent further insertion of the tool. A back side of the lever prevents unauthorized withdrawal of the bill connected with a string-like material which may be pulled outside the inlet.

DETAILED DESCRIPTION OF THE INVENTION

Figure 1:
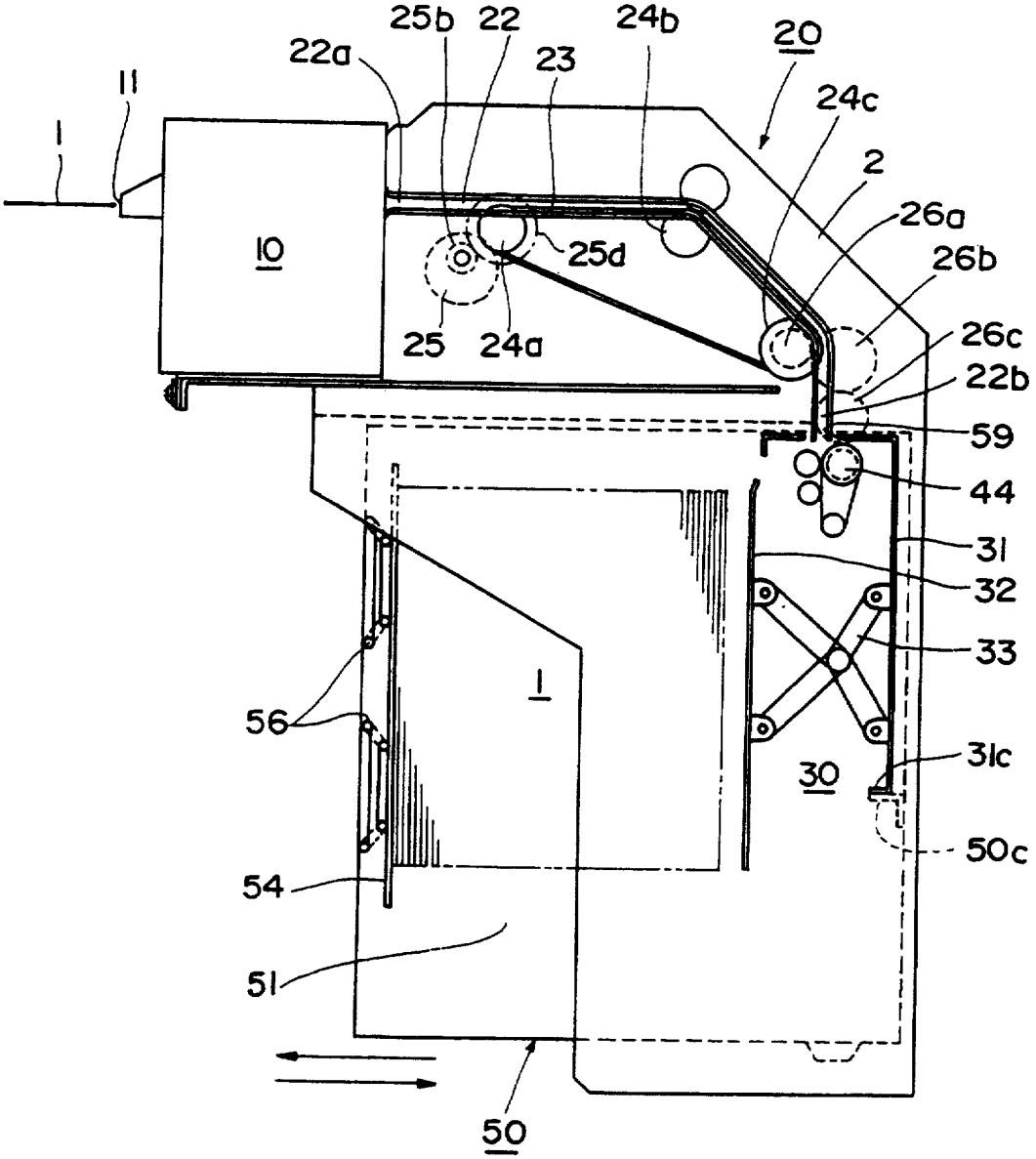
FIG. 1 is a cross-sectional view of an embodiment of a bill handling apparatus according to the present invention.

Referring to FIGS. 1 through 7, an embodiment of a bill handling apparatus according to the device will be described as follows:

FIG. 1 shows a cross-sectional view of an embodiment of the bill handling apparatus according to the present invention. The bill handling apparatus comprises a metallic frame Z; a validator 10 for identifying the authenticity or denomination of a bill or paper currency inserted therein; a conveying device or transporter 20 provided in the frame 2 for conveying the bill 1 supplied from the validator 10 along a passageway defined by guide members 22; a stacker 50 detachably attached to the frame 2 for storing in a compartment 51 the bill 1 traveled from the transporter 20; and a pushing device or pusher 30 provided in the stacker 50 for pushing the bill 1 into the compartment 51. The pusher 30 is drivingly connected with the transporter 20 to obtain drive force.

In FIG. 1, the validator 10 is provided with an inlet 11 at the front side and an inner passageway (not shown) therein following the inlet 11. An exit of the passageway in the validator 10 is connected with a connecting end **22*a* of the passageway formed by the guide members 22. A rear end 22*b* of the passageway is connected with the stacker 50**.

The validator 10 includes detecting means not shown because well known for detecting various physical properties of the bill 1 to determine whether or not it is genuine. As known, sensors of the validator 10 detects magnetic and optical properties of the bill from ingredients of printed inks, paper quality and the colors thereof.

Figure 2:
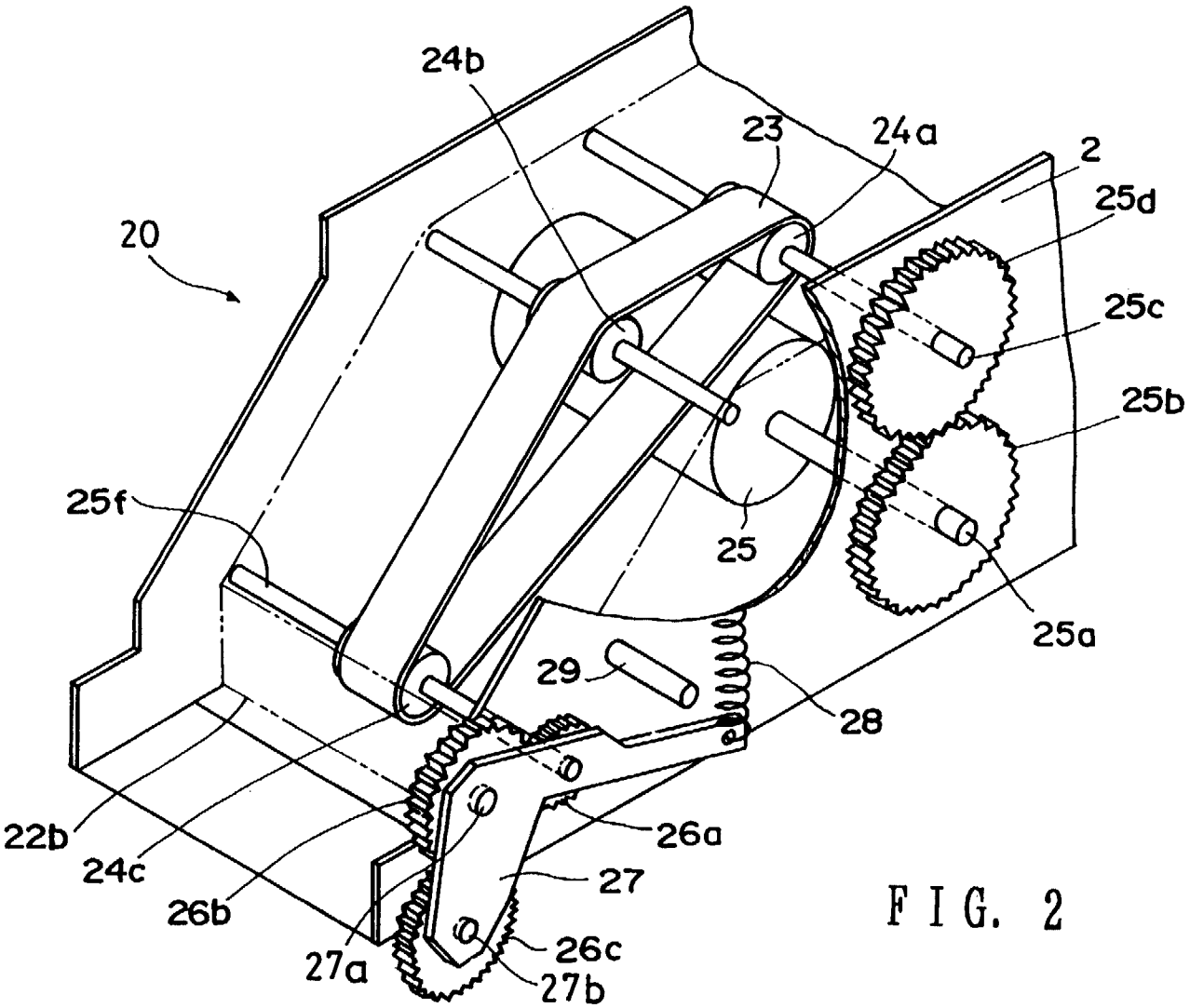
FIG. 2 is a perspective view of a driving mechanism of the transporter used in the bill handling apparatus of FIG. 1.

As shown in FIG. 1, the stacker 50 is detachably housed for sliding movement in the frame 2. As shown in FIGS. 1 and 2, an endless belt 23 is wounded around pulleys **24*a*–24*c* to convey the bill 1 along the passageway of the guide members 22. Therefore, the bill 1, which has been passed through the validator 10, is then transported through the passageway within the transporter 22 by the endless belt 23 and then goes toward the stacker 50. Optical sensors (not shown) are provided to detect passage of the bill 1 through the validator 10 and produce a detection signal to the CPU to start rotation of the motor 25** in one direction.

A motor 25 of driving source operates the endless belt 23 by operating signals supplied thereto from a CPU provided in the validator 10. The rotation of the motor 25 is transmitted to the pulley **24*a* mounted on a shaft 25*c* via a gear 25*d* engaged with a gear 25*b* mounted on a shaft 25*a* of the motor 25 to drive the conveying belt 23 by the pulley 24*a***.

As shown in FIG. 2, a drive gear **26*a* is mounted for rotation on a shaft 25*f* of the pulley 24*c* around which the endless belt 23 is wound. The shaft 25*f* also supports a gear bracket 27 for rotation in addition to the drive gear 26*a* which is meshed with a middle gear 26*b* engaged with an end gear 26*c* for reduction to necessary rotational rate. These middle and end gears 26*b* and 26*c* are supported for their rotation by pins 27*a*, 27*b*** on the gear bracket 27 so that the middle and end gears 26*b*, 26*c* can be rotated by themselves and swayed together with the gear bracket 27 around the shaft 25*f*. One end of a shock absorbing spring 28 is attached to an extremity of the gear bracket 27 and the other end of the shock absorbing spring 28 is fixed to the frame 2 (not shown). Usually, the extremity of the gear bracket 27 is in contact with a stopper pin 29 to prevent its further rotation. However, the gear bracket 27 is rotatable in the clockwise direction around the shaft 25*f* against elastic tensile stress of the shock absorbing spring 28.

Figure 4:
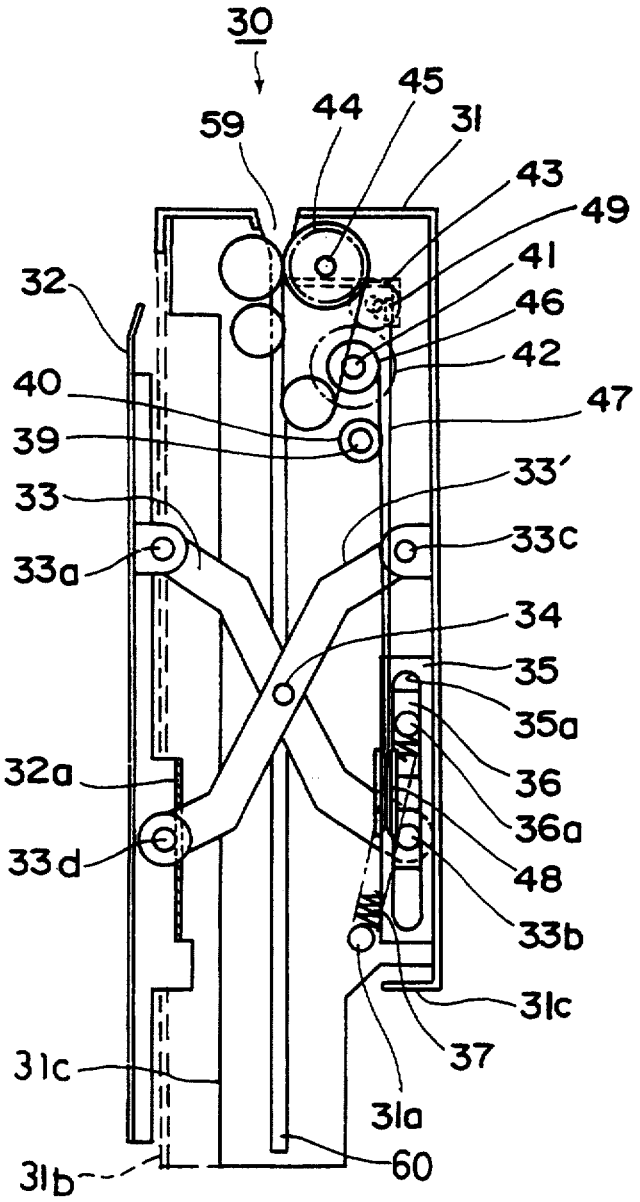
FIG. 4 is a cross-sectional view of the pusher.

The end gear 26*c* is brought into engagement with a passive gear 44 shown in FIGS. 1 and 4 when the stacker 50 is inserted into the frame 2 for incorporation with the transporter 20 after the pusher 30 is disposed within the stacker 50. When the end gear 26*c* contacts the passive gear 44, produced between these gears 26*c* and 44 is impact force which is absorbed by elastic tensile force of the stock absorbing spring 28 at the time of rotation of the gear bracket 27 around the shaft 25*f* to establish smooth engagement between the middle gear 26*c* and the passive gear 44. However, when the stacker 50 is removed from the frame 2, the end gear 26*c* is disengaged from the passive gear 44.

Figure 3:
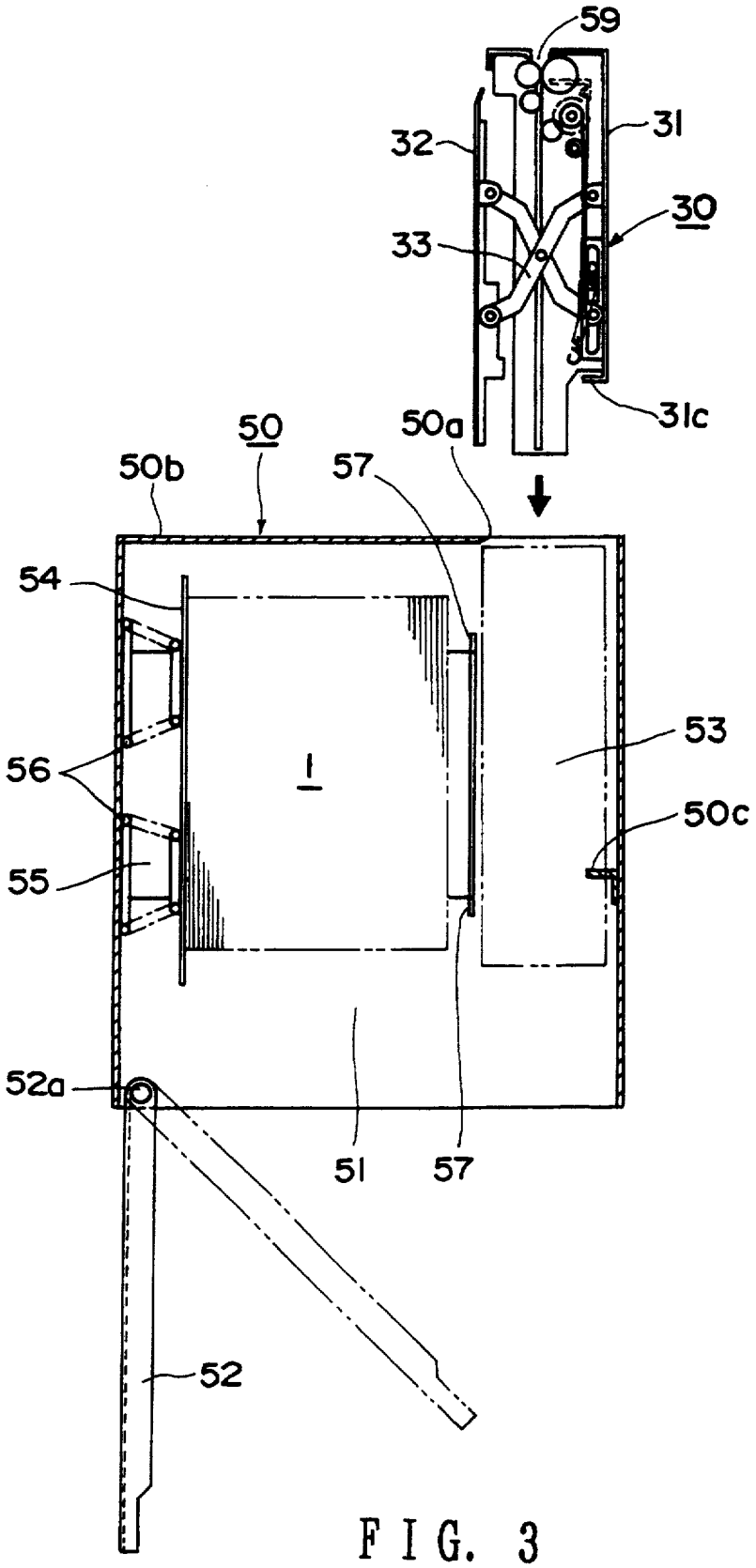
FIG. 3 is a cross-sectional view of a stacker and a pusher attached thereto.

As shown in FIG. 3, a box-shaped casing 50*b* of the stacker 50 is provided with an opening 50*a* through which the pusher 30 may be placed in or removed from a chamber 53 within the casing 50*b*. Also, the casing 50*b* has, adjacent to the chamber 53, a compartment 51 to receive and stores bills. The pusher 30 is located within the chamber 53 in position when a bent portion 31*c* of a base plate 31 of the pusher 30 is in contact with a stopper 50*b* of the casing 50*b*. The pusher 30 may be secured within the casing 50*b* by means of a screw (not shown).

Figure 5:
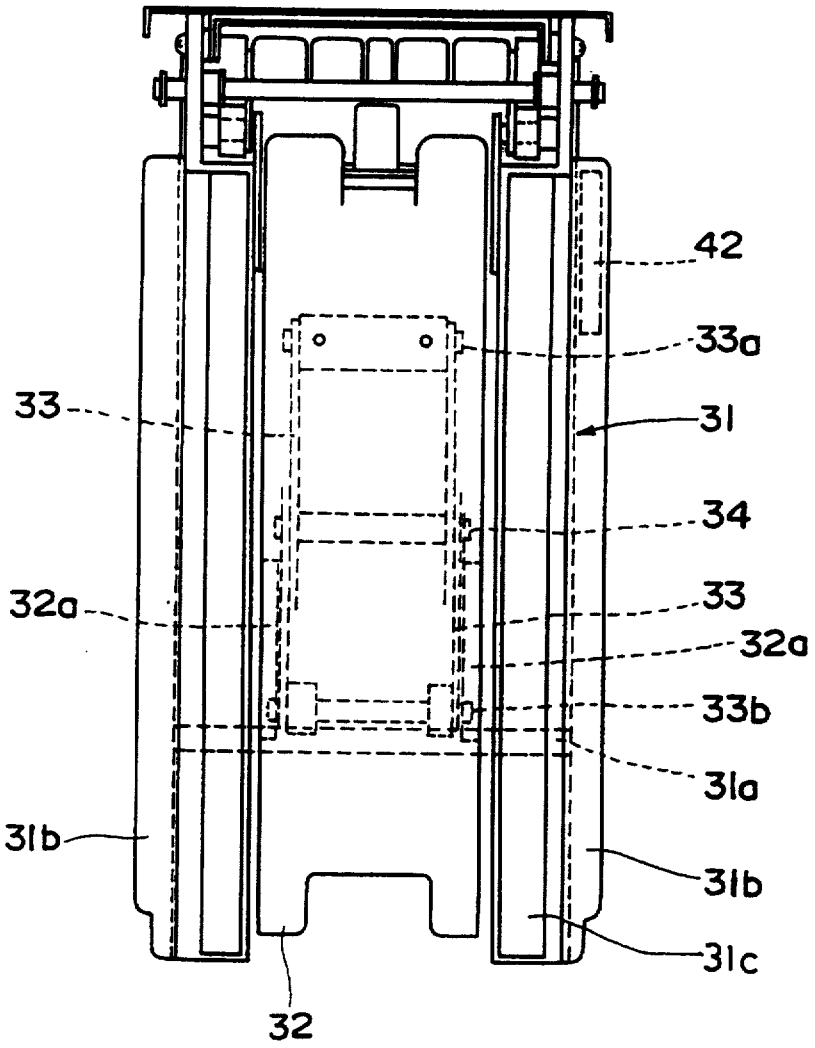
FIG. 5 is a plan view of the pusher.

As shown in FIG. 4, the pusher 30 has a base plate 31 formed with a slit-shaped inlet 59 and a pushing plate 32. The pushing plate 32 may be moved away from and toward the base plate 31 in parallel relation via two pairs of two link members 33 which are hingedly connected with each other in "X" shape by an axle 34 passing through each center portion of these link members 33. FIG. 5 indicates the link members 33 substantially symmetrically provided on each side of the pusher 30. Shafts 33*a* to 33*d* are utilized to hingedly connect each end of the link members 33 with the base plate 31 and the pushing plate 32 to cause parallel movement of the pushing plate 32 relative to the base plate 31.

Figure 6:
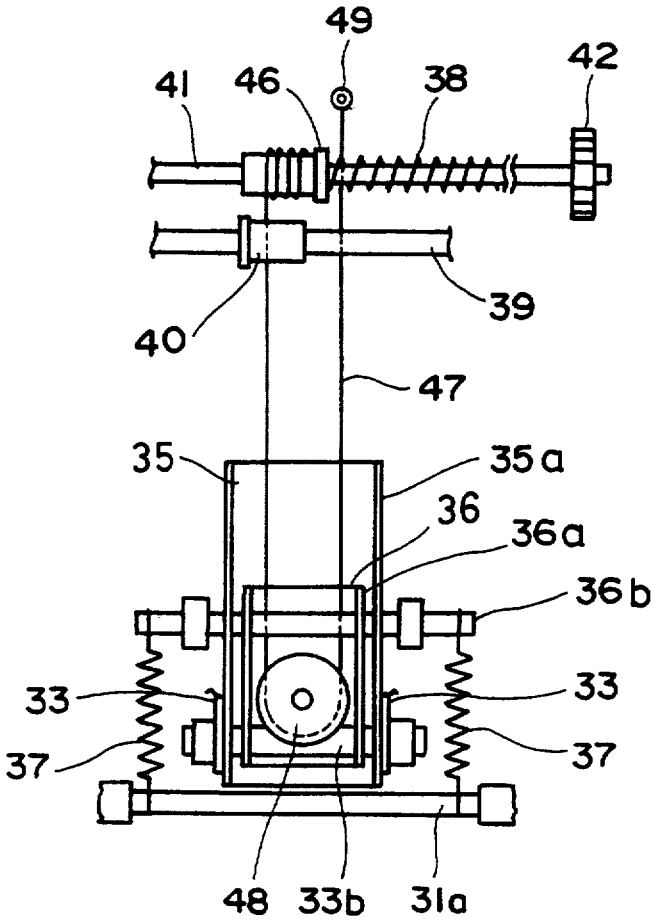
FIG. 6 is a plan view illustrating a drive mechanism of the pusher.

The fixed shaft 33*a* hingedly connects one end of the link member 33 with the pushing plate 32. The fixed shaft 33*c* hingedly connects one end of the link member 33' with the base plate 31. Rigidly secured to the base plate 31 is a bracket 35 having a pair of bent portions 35*a* each formed with an elongated hole 35*a*. As illustrated in FIG. 6, positioned inside the bent portions 35*a* of the bracket 35 is a slider 36 having a pair of bent portions 36*a*. The shafts 33*b* pass through holes formed with bent portions 36*a* and are movable within the elongated holes 35*a* of the bracket 35. The shafts 33*b* support each end of the link members 33 to hingedly connects the other end of the link member 33 with the slider 36. Similarly to the shaft 33*b*, a shaft 36*b* pass through holes formed with the bent portions 36*a* and are movable within the elongated holes 35 of the bracket 35 integrally with the shaft 33*b*. Each one end of a pair of tensile springs 37 is engaged with the shaft 36*b*, and each the other end of the tensile springs 37 is engaged with an axis 31*a* secured to the base plate 31. A pulley 48 is attached to the slider 30 for rotation. The shaft 33*d* hingedly connects the other end of the link member 33' with the pushing plate 32, and is movable along a bent edge 32*a* of the pushing plate 32.

As shown in FIGS. 4 and 6, a winding gear 42 and passive gear 44 are respectively mounted for rotation on shafts 41 and 45 which are supported by the base plate 31. A middle gear 43 is engaged between the gears 42 and 44 to transmit rotational force from the shaft 45 to 41. Mounted on the shaft 41 is a winding roller 46 which has an one-way clutch device (not shown) disposed between the shaft 41 and the winding roller 46.

Fixed to the winding roller 46 is one end of a tensile wire 47 which is wound around a roller 40 mounted on a shaft 39 and a pulley 48 rotatably supported on the slider 36. The other end of the wire 47 is fastened to a pin 49 fixed to the base plate 31. Wound around the shaft 41 is a twisted spring 38 both ends of which are respectively fixed to the winding roller 46 and the base plate 31 to prevent the tensile wire 47 from being loosened when the winding roller 40 is forcibly rotated.

Due to the one-way clutch device of the winding roller 46, the winding roller 46 is rotated to wind up the tensile wire 47 therearound while the shaft 41 is rotated in the reverse direction, however, the winding roller 46 is free when the shaft 41 is rotated in the forward direction and thereby the tensile wire 47 is released from the winding roller 46 because the pulley 48 together with the slider 36 is moved away from the winding roller 46 by clastic force of the tensile springs 37. As understood from FIG. 4, when the shaft 41 is rotated in the reverse direction to wind up the tensile wire 47 around the winding roller 46, the pulley 48 is pulled by the tensile wire 47 so that the slider 36 and shaft 33*b* are moved toward the winding roller 46 and therefore the pushing plate 32 stretches from the base plate 31 to the extended position within the compartment 51. Adversely, when the shaft 41 is rotated in the forward direction, the pulley 48, slider 36 and shaft 33*b* are moved away from the winding roller 46 so that the pushing plate 32 is returned to the retracted position toward the base plate 31 beyond the rest position 60 of the bill 1.

When the stacker 50 is inserted into the frame 2, the passive gear 44 is brought into engagement with the end gear 26*c* so that the rotational force of the end gear 26*c* is smoothly transmitted to the passive gear 44 and hence the winding gear 42 is rotated via the middle gear 43. Thus, the link members 33 are driven by the motor 25 of the transporter 20.

If the transporter 20 is driven by the motor 25 to carry the bill 1, the pusher 30 is inoperative due to the one-way clutch device of the winding roller 46. For that reason, the pusher plate 32 is returned to the retracted position by clastic force of the tensile springs 37 until the bill 1 supplied from the inlet 59 reaches the rest position 60 between the pusher plate 32 and back plate 54 so that the bill 1 can be pushed by the pusher 30 into the compartment 51.

A sensor (not shown) detects passage of the rear end of the bill 1 which has passed through the transporter 20 and reached the rest position 60 within the pusher 30. In accordance with the detection signals produced by the sensor upon passage of the bill 1, the CPU generates outputs to reversely rotate the motor 25 whose driving force is transmitted through the shaft 25, gears 25*b*, 25*d*, shaft 25*c*, pulley 24*a*, endless belt 23, shaft 25*f*, gears 26*a* to 26*c*, gears 44, 43, 42, shaft 41 and winding roller 46. Thus, the winding roller 46 is rotated via the one-way clutch device of the winding roller 46 to operate the pusher 30.

Figure 7:
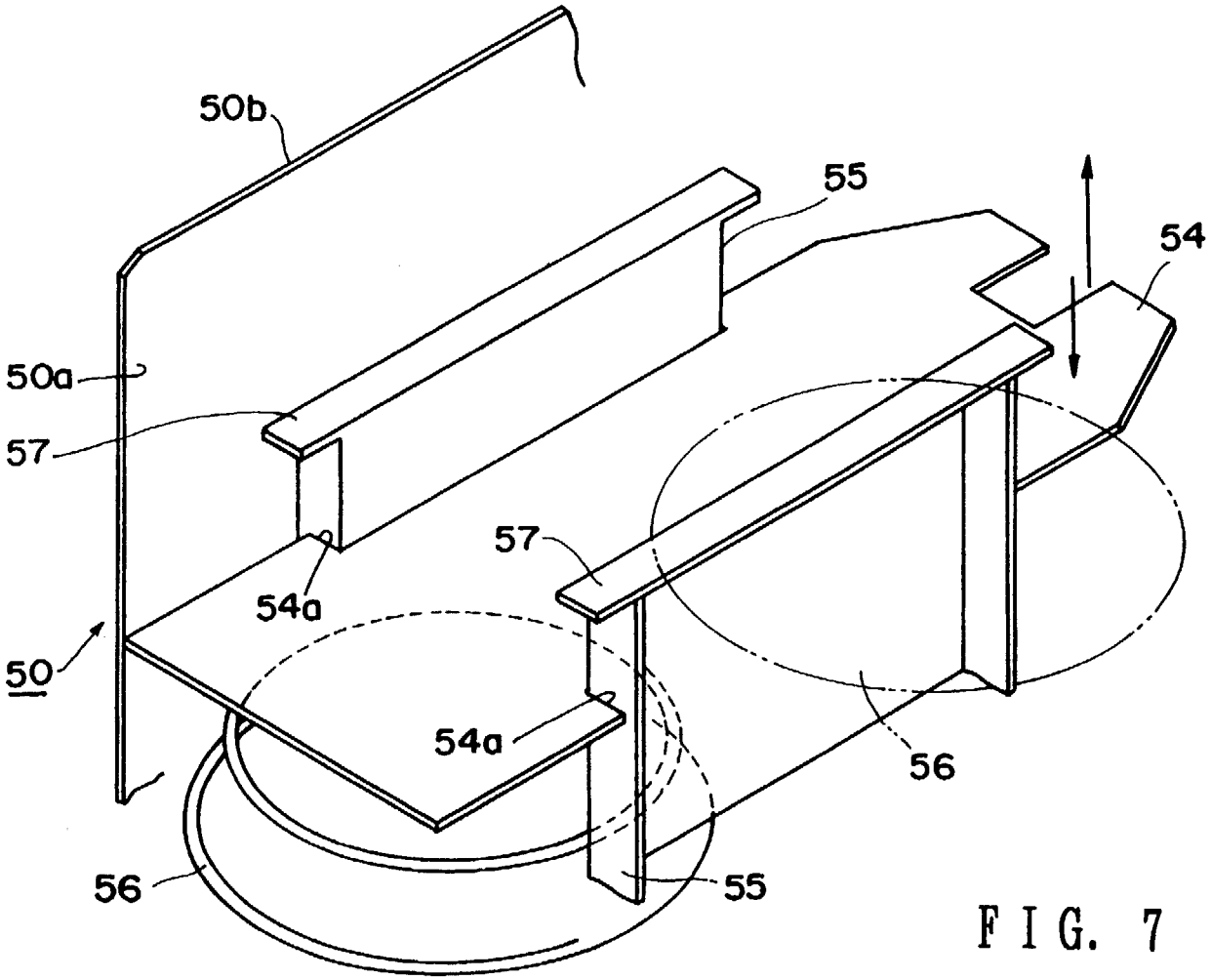
FIG. 7 is a partial perspective view of the stacker.
Figure 8:
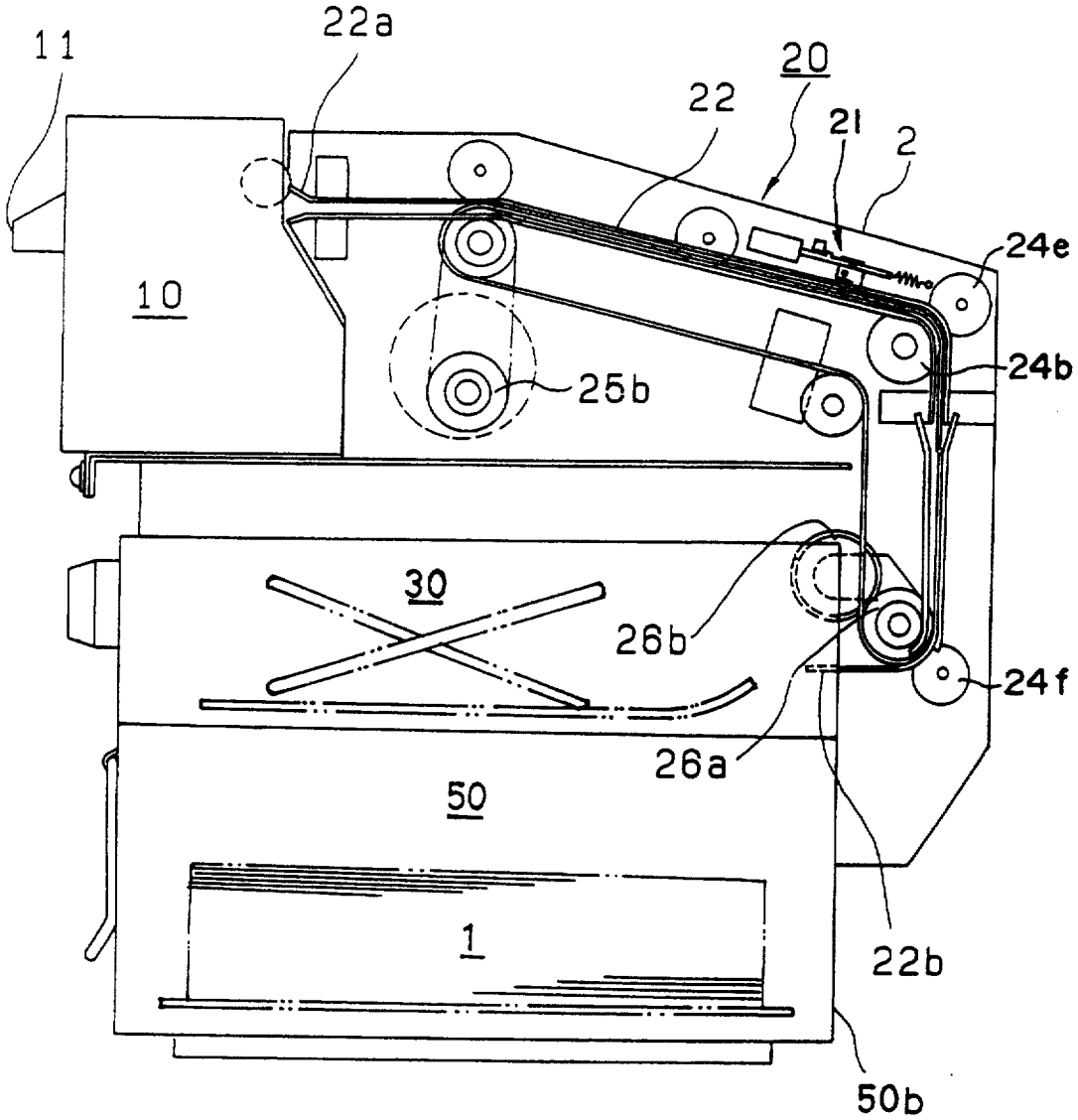
FIG. 8 is a cross-sectional view indicating another embodiment of the bill handling apparatus of the present invention.
Figure 9:
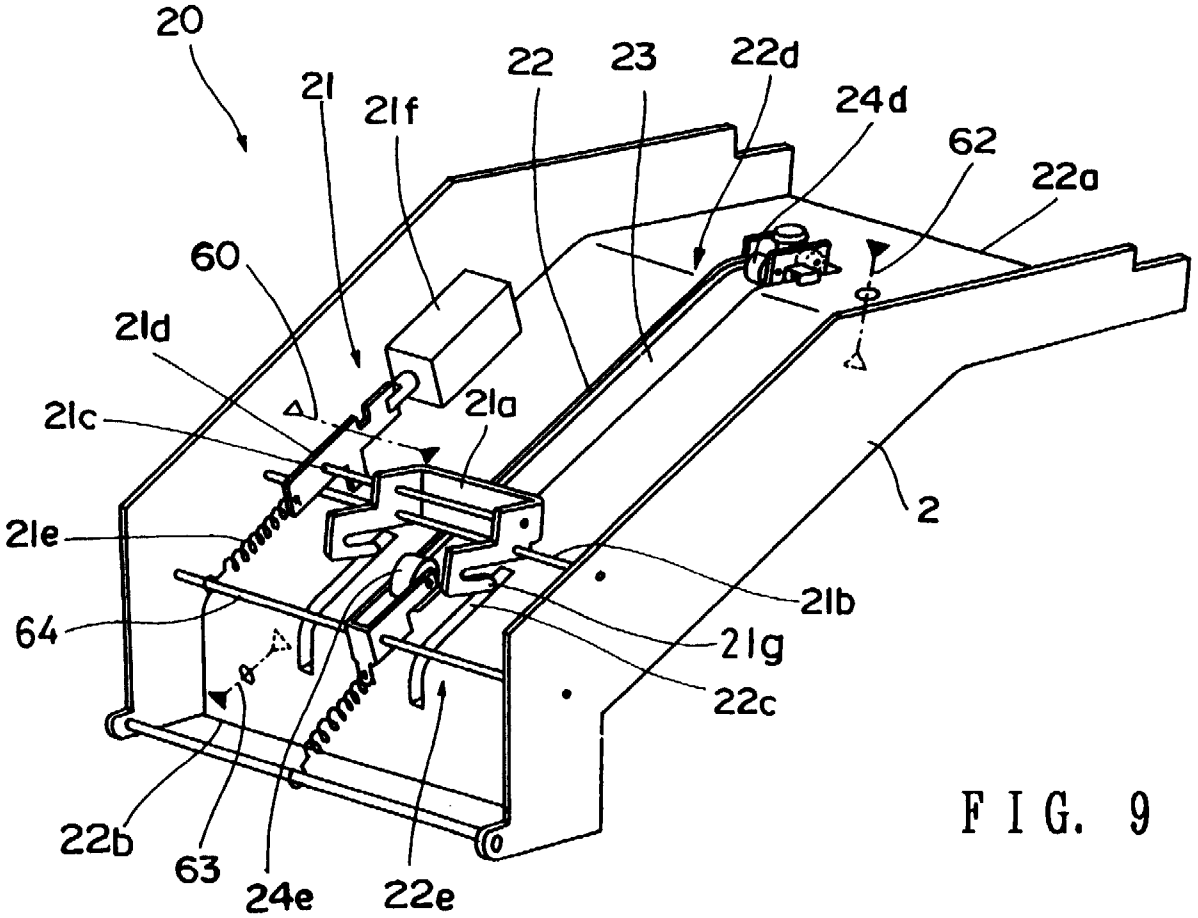
FIG. 9 is a perspective view of a transporter mounted on the bill handling apparatus of FIG. 8.

As shown in FIG. 3, a door plate 52 is attached to the bottom of the casting 50*b* by a hinge shaft 52*a* to open or close the door plate by rotation. As shown in FIGS. 3 and 7, positioned within the compartment 51 of the stacker 50 is a back plate 54 formed with a pair of cutaways 54*a* that respectively engage with a pair of guide members 55 respectively arranged on side walls of the casing 50*b* . The back plate 54 may move along the guide members 55. The back plate 54 is resiliently urged by two springs 56 toward the chamber 53. A pair of stoppers 57 are formed at both ends of each guide members 55 to prevent further movement of the back plate 54 into the chamber 53 upon contact of the back plate 54 and the stoppers 57. As illustrated in FIGS. 4 and 5, the base plate 31 has a pair of aprons 31*b* which project from both edges of the base plate 31. When the pusher 30 is inserted into the casing 50*b*, the aprons 31*b* of the base plate 31 are brought into contact with the stoppers 57 and then the pusher 30 is moved along and guided by the stoppers 57 and thereby the pusher 30 can be easily housed in the chamber 53 of the casing 50*b*. Width of the pushing plate 32 is slightly smaller than a distance between the guide members 55 so that the pushing plate 32 can be moved within the compartment 51 toward and away from the back plate 54.

When the bill 1 supplied from the transporter 20 reaches the rest position 60 before the back plate 54 engaged with the stoppers 57, the pusher 30 operates to travel the pushing plate 32 toward the back plate 54, and therefore the bill 1 is pushed into the compartment 51 and upon further movement of the pushing plate 32, the bill 1 and back plate 54 are moved away from the pusher 30 against elastic force of the springs 56.

In assemblage, the pusher 30 is inserted into the stacker 50 from the opening 50*a* of the casing 50*b* and is disposed in position upon contact of the bent portion 31*c* of the base plate 31 and the stopper 50*c* of the casing 50*b*. Then, the stacker 50 is inserted into the frame 2 of the apparatus so that the inlet 59 of the pusher 30 is connected with the rear exit 22*b* of the guide members 22. At the same time, the passive gear 44 of the pusher 30 comes into engagement with the end gear 26*c* to transmit rotating force from the passive gear 44 to the end gear 26*c*. The shock absorbing spring 28 reduces impact force produced between the passive gear 44 to the end gear 26*c*.

In use, a bill 1 is inserted into the inlet 11 of the validator 10 and is conveyed by the belt-pulley arrangement into the validator 10 to check whether or not it is a genuine bill. When the CPU decides that the bill 1 is not a genuine bill by electric signals of physical properties of the bill 1, the belt-pulley arrangement is reversely operated to return the bill 1 to the inlet 11. When the CPU validates that the bill is a genuine bill, the belt-pulley arrangement conveys it to the connecting end 22*a* of the passageway within the transporter 20. Then, the bill is forwarded by the endless belt 23 along the passageway toward the stacker 50 while the endless belt 23 is driven by the motor 25, however the winding pulley 46 is not rotated due to inoperative condition of the one-way clutch device when the pushing plate 32 is in the retracted position.

Subsequently, the bill 1 is supplied by the transporter 20 through the inlet 59 into the rest position 60 of the pusher 30 and the sensor detects arrival of the bill to the rest position 60 to produce a detection signal upon which the CPU causes the motor 25 to reversely rotate. So, driving force of the endless belt 23 rotates the winding pulley 46 to wind up the wire 47, and therefore, the link members 33' are stretched and the pusher plate 32 is moved from the retract to extended position. Thereby, the bill 1 in the rest position, is pushed into the compartment 51 together with the back plate 54 against elasticity of the springs 56.

After the bill 1 is pushed into the compartment 51, the motor 25 is again rotated in the forward direction and the slider 36 is pulled toward the side of the fixed axis 31*a* of the base plate 31 by restoring force of the springs 37, and then, the link members 33 are retracted so that the pushing plate 32 is returned to the retracted position. At the same time, the back plate 54 is moved by restoring force of the spring 56 toward the pusher 30, and thereby the bills 1 loaded on the back plate 54 is pushed toward a pair of edges 31*c* of the pusher 30. This operation is repeated until a predetermined amount of the bills 1 are accumulated within the compartment 51.

When the stacker 50 is removed from the frame 2, the passive gear 44 of the pusher 30 is automatically disengaged from the middle gears 26*c* of the transporter 20. When the door plate 52 of th stacker 50 is opened, the bills 1 may be removed from the compartment 51 while the back plate 54 is moved toward the stoppers 57 along the guide members 55 by restoring force of the springs 56 until the back plate 54 makes contact with the stopper 57.

When the fixing screw (not shown) for the pusher 30 is loosened and removed from the casing 50*b*, the pusher 30 may be removed from the casing 50*b* of the stacker 50 and attached to another stacker with a casing of different capacity for storing bills.

In order to change capacity for storing bills in the stacker, the pusher 30 may be applied for common use to another stacker with its compartment of different volume and therefore there is no need to prepare a new pusher of different size or type. In addition, when the pusher 30 is in malfunction, it may easily be removed for exchange with a new pusher 30. Obviously, this means that a same pusher 30 is applicable to stackers of various size without change of the pusher in size and without increase of kind or type of the pusher for easy maintenance. The pusher 30 can easily be inserted along the guide members 55 in the chamber 53 within the casing 50*b* of the stacker 50.

FIGS. 8 to 11 indicate another embodiment of the present invention which is provided with hook means 21 to prevent unauthorized withdrawal of the bill in the stacker 50 outside the apparatus. The hook means 21 comprises a shaft 21*b* attached to the frame 2 near a bent portion 22*e* of the passageway defined by the guide members 22; a lever 21*a* rotatably mounted on the shaft 21*b* and formed with notches 21*g*; a drive member 21*d* connected with the lever 21*a* via a connecting pin 21*c*; a solenoid 21*f* as drive means for pulling the drive member 21*d* upon energization; a tensile spring 21*e* mounted between the drive member 21*d* and a shaft 64 secured to the frame 2; and an optical sensor 60 for detecting movement of the drive member 21*d*. Also, provided near the connecting end 22*a* and rear end 22*b* of the guide members 22 are optical sensors 62, 63 for detecting entrance and discharge of the bill 1. Electric outputs from these optical sensors 62, 63 are supplied to the CPU to operate the solenoid 21*f*. Pulleys 24*d* and 24*e* are provided to smoothly convey the bill 1 along the passageway.

Figure 10:
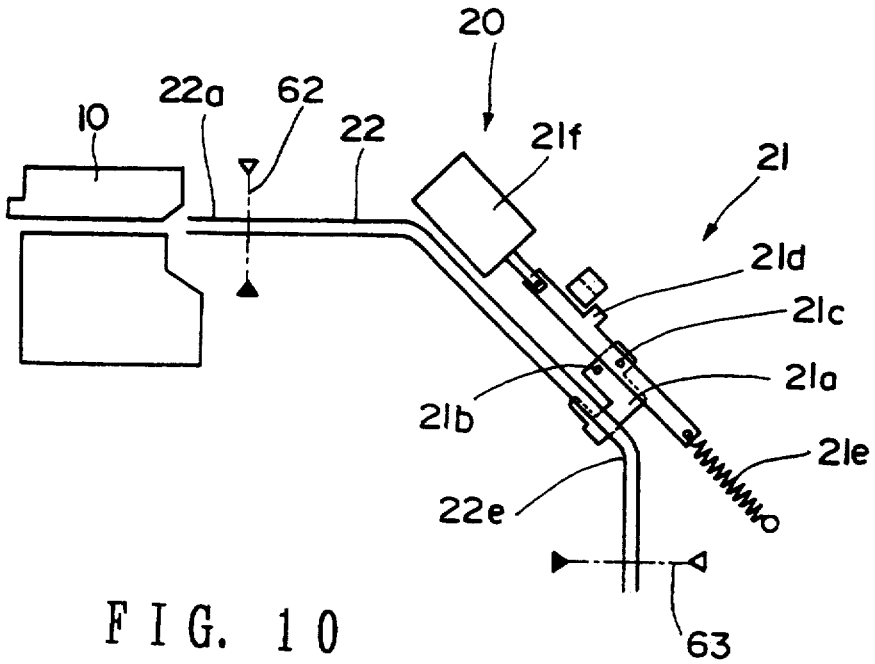
FIG. 10 is a simplified cross-sectional view of the transporter of FIG. 9 with hook means in operative position.
Figure 11:
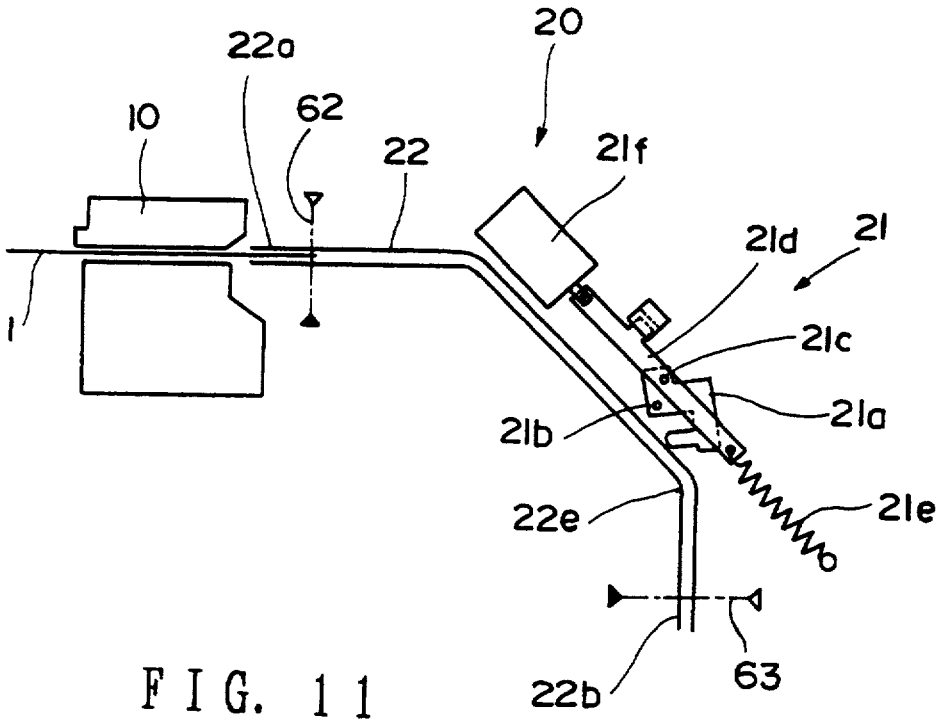
FIG. 11 is a simplified cross-sectional view of the transporter of FIG. 9 with hook means in inoperative position.

The lever 21*a* is usually in an operative position as shown in FIG. 10 projecting into the passageway of the bill 1 so that the notches 21*g* can receive a tool which might be inserted to rotate the lever 21*a* for the purpose of unauthorized withdrawal of the bill 1 in the stacker 50. A back side of the lever 21*a* prevents unauthorized withdrawal of the bill 1 connected with a string-like material which may be pulled outside the inlet 11 as further rotation of the lever 21*a* is prevented. When entrance of the bill supplied from the validator 10 is detected by the optical sensor 62, the solenoid 21*f* is operated to pull the drive member 21*d* against elastic force of the spring 21*e* and therefore, the lever 21*a* is rotated from the operative position of FIG. 10 to an inoperative position of FIG. 11 wherein the lever 21*a* is retracted from the passageway to allow passage of the bill 1. When the optical sensor 63 detects discharge of the bill from the transporter 20, the optical sensor 63 furnishes a detection signal for the CPU which then ceases the output to the solenoid 21*f*. Accordingly, the drive member 21*d* is returned to its original position by elastic force of the spring 21*e* so that the lever 21*c* is returned to the operative position of FIG. 10.

Practical embodiments and modes of the present invention may be modified in various ways without limitation to the foregoing embodiment. For example, the stoppers 57 may be provided independently from the guide members 55.

As described above, since the pusher can be easily attached to or detached from the stacker in accordance with the present invention, the pusher may be used for various stackers of different size to change storing capacity of the compartment. Removal and replacement of the pusher are easy for maintenance or repair of the apparatus.

What is claimed is:

1. In a bill handling apparatus including a validator for checking a bill fed into the apparatus whether or not said bill is genuine; a slacker detachably mounted in the apparatus and having a casing for defining a compartment to store the accumulated bills; and a transporter for transporting the bill along a passageway from said validator to said stacker, the improvement comprising:

a chamber defined by said casing of said stacker;

a pusher removably located within said chamber of said stacker and drivingly connected with said transporter for pushing the bill into the compartment;

an opening formed in said casing in the vicinity of said chamber for passing said pusher; and a slit-shaped inlet formed in a base plate of said pusher for receiving the bill within said pusher, said inlet being connected to an exit of the passageway of the transporter.

2. The bill handling apparatus of claim 1, wherein said transporter comprises a motor for driving an endless belt and an end gear driven by said motor; said pusher comprises a passive gear for operating link members to push said bill from the chamber into the compartment, said passive gear being brought into engagement with said end gear of the transporter for driving connection, said passive gear being capable of being disengaged from said end gear when said stacker is removed from the transporter.

3. The bill handling apparatus of claim 2, wherein said transporter further comprises a gear bracket for hingedly supporting said end gear; and a shock absorbing spring provided between said gear bracket and a frame of the apparatus for absorbing impact force produced between said end and passive gears when said stacker is incorporated with said transporter.

4. The bill handling apparatus of claim 1, wherein said pusher comprises link members and a pusher plate hingedly connected with said link members; said link members traveling said pusher plate between the retracted and extended positions by virtue of elastic force of a spring and driving force of a motor provided in the transporter.

5. The bill handling apparatus of claim 4, wherein said pusher comprises a winding gear rotatably mounted on a shaft and being driven through an end gear of said transporter when said stacker is incorporated with said transporter; a winding roller mounted on said shaft via one-way clutch device contained therein; a slider slidably mounted on a base plate of said pusher for hingedly supporting one end of said link members; a slider pulley rotatably mounted on said slider; a slider spring for resiliently urging said slider away from said shaft; and a tensile wire wound around said slider pulley, one end of said tensile wire being connected with said base plate and the other end of said tensile wire being wound around said winding roller;

whereby said one-way clutch allows to release the tensile wire from the winding roller by resilient force of said slider spring when said motor is driven in the forward direction to convey the bill through said passageway in the transporter so that said slider is moved away from said winding roller, and said link members and pusher plate are carried to the retracted position; said one-way clutch device serves to rotate the winding roller together with said shaft to wind up the tensile wire around said winding roller when said motor is driven in the reverse direction so that said slider is moved toward said winding roller, and said link members and pusher plate are carried to the extended position.

6. The bill handling apparatus of claim 1, wherein said stacker comprises a pair of guide members each attached on a side wall of the casing; and a back plate movable along said pair of guide members;

7. The bill handling apparatus of claim 6, wherein said stacker further comprises a spring for resiliently urging the back plate toward the pusher; and a pair of stoppers each provided at both ends of said guide members to prevent said back plate from entering into a front portion of said compartment.

8. The bill handling apparatus of claim 1, wherein said transporter provides at least a bent portion with said passageway and comprises hook means for preventing extraction of the bill within said stacker outside the apparatus, said hook means being mounted between said bent portion and said stacker.

9. The bill handling apparatus of claim 8, wherein said hook means comprises sensing means provided on the passageway within said transporter for detecting passage of said bill supplied from said validator; a lever rotatable between its operative position projecting into said passageway and its inoperative position retracted from said passageway; and drive means for operating said lever of said hook means when said sensing means detects the passage of said bill.

* * * * *